United States Patent [19]

Varcoe et al.

[11] 4,079,719

[45] Mar. 21, 1978

[54] TIMING CONTROL FOR FUEL PUMP

[75] Inventors: Ellis Varcoe, Simsbury, Conn.; William Walter Tease, Feeding Hills, Mass.

[73] Assignee: Stanadyne, Inc., Windsor, Conn.

[21] Appl. No.: 670,752

[22] Filed: Mar. 26, 1976

[51] Int. Cl.[2] ..... F02M 39/00

[52] U.S. Cl. ..... 123/139 AQ; 417/218

[58] Field of Search ..... 123/139 AQ; 417/218

[56] References Cited

U.S. PATENT DOCUMENTS

| | | | |
|---|---|---|---|
| 2,660,992 | 12/1953 | Rossa | 417/218 |
| 3,051,154 | 8/1962 | Kemp | 123/139 AQ |
| 3,116,728 | 1/1964 | Evans | 123/139 AQ |
| 3,394,688 | 7/1968 | Rossa | 123/139 AQ |
| 3,433,159 | 3/1969 | Kemp | 123/139 AQ |
| 3,771,506 | 11/1973 | Davis | 417/218 |

*Primary Examiner*—Charles J. Myhre
*Assistant Examiner*—R. A. Nelli
*Attorney, Agent, or Firm*—Prutzman, Hayes, Kalb & Chilton

[57] ABSTRACT

A fuel injection pump including a charge pump for delivering discrete pulses of high pressure liquid fuel sequentially to the several cylinders of an associated engine is provided with an angularly adjustable cam ring to control the timing of the pumping strokes. The position of the cam ring is controlled by an advance piston, the position of which is controlled by a hydraulic pressure correlated with engine speed. A load sensing piston, engageable with one end of the advance piston above a fixed amount of timing advance, is subjected to the pressure of the metered fuel down-stream of the metering valve which controls the quantity of fuel delivered by the pump to urge the advance piston in a direction to retard the timing of the pumping strokes to result in a timing control system in which the timing is more advanced at high speeds and light load than it is at high speeds and full load.

8 Claims, 1 Drawing Figure

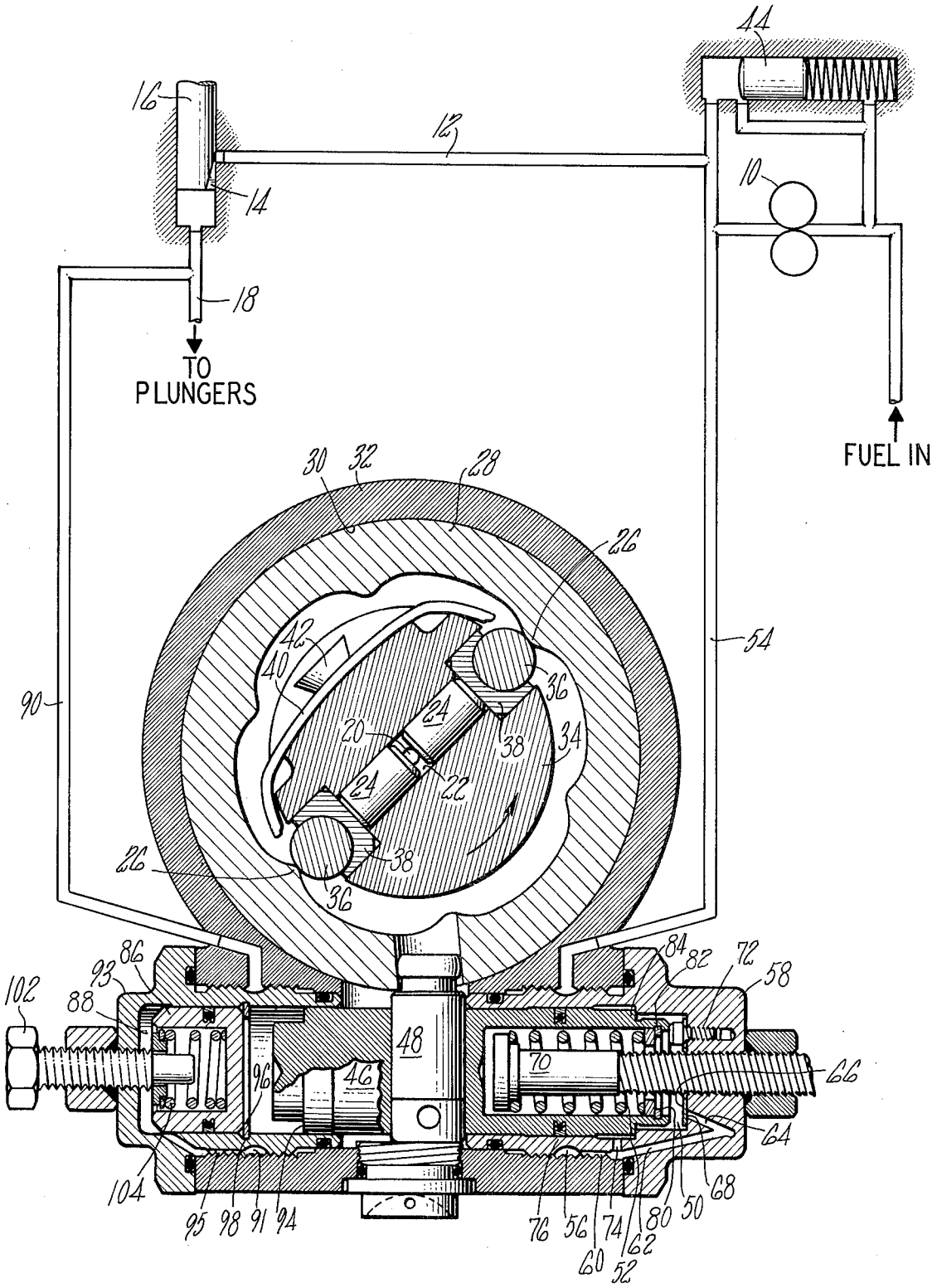
TO
PLUNGERS
FUEL IN

TIMING CONTROL FOR FUEL PUMP

This invention relates to liquid fuel injection pumps for internal combustion engines and more particularly to an improvement in such fuel pumps for automatically controlling the timing of the pump in response to variations in engine load.

Fuel injection pumps of the type referred to above deliver metered charges of liquid under high pressure in sequence to the several cylinders of an associated engine in timed relation therewith. A cam ring of the pump having inwardly directed cam lobes surround one or more rotor mounted pumping plungers which produce the high pressure charges of fuel so as to move the pump plungers bodily relatively to the cam to translate the configuration of the cam lobes to the desired timed pumping strokes.

In order to increase the efficiency and smoothness of operation of the engine, it is frequently the practice to advance the timing of injection of fuel to the cylinders at increased engine speeds. This may be accomplished by adjusting the angular position of the cam which is mounted for limited angular movement and is restrained from rotating by an advance piston and a connecting pin.

In certain types of engines, it has also been found desirable to advance the timing a certain amount at full load on the engine and a further amount at reduced engine loads.

It is the primary object of the invention to provide an improved timing means for a fuel injection pump which varies the timing of the pump in response to the load on the engine associated with the pump. Included in this object is the provision of a timing control wherein the injection timing is advanced further at reduced engine load than it is at full load.

It is a further object of the invention to provide a new and novel injection timing means which provides additional advance at light loads wherein the setting of the metering valve automatically regulates both the amount of fuel delivered to the engine and the timing of fuel injection.

Other objects will be in part obvious and in part pointed out more in detail hereinafter.

A better understanding of the invention will be obtained from the following description and the accompanying drawing of an illustrative application of the invention.

In the drawing, the single FIGURE is an end elevation view, partially in section and partly schematic, of a fuel pump incorporating the invention.

Referring now to the drawing in detail, there is illustrated a fuel pump suitable for the practice of the present invention. Such a pump is similar to that disclosed and claimed in U.S. Pat. No. 3,771,506 which issued Nov. 13, 1973.

As shown, fuel under pressure is delivered from the output of the transfer pump 10 to a passage 12 for delivery to a metering valve passage 14 wherein a metering valve 16 provides a variable restriction to control the flow of fuel delivered by passage 18 which is connected by rotor passage 20 to pump chamber 22 of the high pressure pump shown as comprising reciprocable pump plungers 24 which are simultaneously urged inwardly by cam lobes 26 of a cam ring 28 which is mounted for limited angular movement in a bore 30 of the pump housing 32.

As is well known in the art, rotor passage 20 sequentially communicates with passage 18 as the rotor 34 rotates when the pump plungers 24 are free to move outwardly to charge the pump chamber 22 with a charge of fuel the amount of which is determined by the setting of the metering valve. Continued rotation of the rotor 34 interrupts the communication between the rotor passage 20 and the passage 18 and the cam rollers 36 engage the cam lobes 26 and act through roller shoes 38 to force the plungers 24 inwardly to pressurize the fuel contained in pump chamber 22 to high pressure. The high pressure fuel in the pump chamber 22 is delivered by the passage 20 to a series of passages, not shown, positioned around the distributor rotor 34 for sequential registry with the passage 20 in a known manner to deliver the charges of fuel from the pump chamber 22 sequentially to the several cylinders of the associated engine.

The maximum outward radial movement of the shoes 38 is limited by the ends of the leaf spring 40 adjustably mounted by a screw 42.

A spring biased pressure regulating valve 44 is provided to control the output pressure from the transfer pump 10 so that it varies with the speed of the engine driving the fuel pump.

To vary the timing of injection of the fuel into the associated cylinders of the engine, the cam ring 28 is mounted in a bore 30 in the pump housing 32 for limited angular movement to adjust the angular position of the cam lobes 26 and is restrained from rotating by piston 46 of the automatic advance mechanism and a connecting pin 48.

As shown in the drawing, a closed chamber 50 is formed at one end of the bore in which piston 46 is slidably mounted and piston 46, which is biased to the right by a spring 52, receives liquid fuel through the passage 54, connected to the outlet of the transfer pump 10, annulus 56 around the cap sleeve 58 which is provided with an axial groove 60 to provide open communication with the passage 62, 64 of the cap sleeve 58. A flat annular reed valve 66 overlies port 68 in the wall of chamber 50 and is mounted around an adjustment screw 70 by means of a pair of mounting screws 72 (only one of which is shown) to provide a flat ring seal for accommodating one-way flow of fuel into the chamber 50. High impact pulses of pressure produced on the rollers 36 riding over the cam lobes 26 automatically seats the reed valve 66 to trap the fuel in the chamber 50 and to prevent reverse flow in passage 64.

A bleed orifice 74, as well as leakage past piston ring 76, allows for the gradual bleeding of fuel from chamber 50 when the pressure in chamber 50 decreases to allow the piston 46 to assume a new position of equilibrium at lower engine speed.

One end of advance piston biasing spring 52 is seated against the head of adjusting screw 70 and the other end is fixed relative to the piston 46 by a split stop ring 80 received in a groove 82 of the advance piston. With this arrangement, the adjusting screw 70 serves to adjust the rate of advance by adjusting the spring force and change the actual position assumed by the piston 46 at equilibrium at different engine speeds. A shoulder 84 on the piston 46 engages a shoulder of the cap sleeve 58 to fix the maximum retard setting of the cam ring 28.

So far as the structure of the cam and the adjusting mechanism just described are concerned, these are generally the same as those described in prior U.S. Pat. No. 3,771,506.

In accordance with this invention, means are provided for modifying the timing of injection in response to load. As shown, a load sensing piston 86 is provided to engage the left end of the advance piston 46. Metered fuel from the metering valve 16 communicates with a closed hydraulic chamber 88 at the end of the load sensing piston 86 through passage 90, annulus 91, around the cap sleeve 93 which is provided with an axial passage groove 95 to hydraulically power the load sensing piston. As will be understood, fuel pressure in chamber 88 varies as the metering valve 16 is opened and closed in accordance with changes in engine load.

The advance mechanism of this invention operates as follows.

When the engine is started, injection timing is retarded with the shoulder 84 of the advance piston 46 bottomed on the mating shoulder in the cap sleeve 58 since the biasing force of the spring 52 is greater than the hydraulic pressure at the output of transfer pump 10. As the engine speed increases, the output pressure of transfer pump 10 increases and moves the speed advance piston 46 causing cam ring 28 to turn in the opposite direction of rotation to that of rotor 34 to advance injection timing. When the engine is operating at high speed and low load, injection timing is at maximum advance with the shoulder 94 of the advance piston 46 in engagement with the split ring stop 96 positioned in groove 98 of cap sleeve 93. Since there is very little load on the engine at high speed and low load, the metering valve 16 is nearly closed and the pressure in passage 90 is low so that the load sensing piston 86 does not prevent the advance piston 46 from reaching its position of maximum advance.

When load on the engine increases, the metering valve 16 is opened an increased amount thereby increasing the hydraulic pressure in the passage 90 and in the chamber 88 for powering the load sensing piston. This increased pressure in chamber 88 aides the advance spring 52 in moving the advance piston 46 in the same direction as rotor rotation against the bias of the hydraulic pressure in chamber 50 until an equilibrium position is reached, and the injection timing is retarded.

When the engine is operating at high speed and full load, the metering valve is opened the maximum amount to raise the pressure in chamber 88 to its maximum level at the speed at which the engine is operating. This causes the load sensing piston 86 to assume its extreme position bottomed against the split stop 96 to lessen the amount of advance of injection timing so that the injection timing at full load is less than it is at lower load.

If desired, a trimmer screw 102 and a bias spring 104 can be added to the load sensing piston construction for tailoring advance performance to specific applications.

If desired, a helical compression spring could be positioned between load sensing piston 86 and advance piston 46 to apply a biasing force assisting biasing spring 52 thereby to control the position of advance piston 46 according to load at all loads.

As will be apparent to persons skilled in the art, various modifications, adaptations and variations can be made from the foregoing specific disclosure without departing from the teachings of the present invention.

We claim:

1. A fuel injection pump comprising a cam, pump plungers movable relative to the cam to translate the contour of the cam to sequential pumping strokes, a first source of fluid under a pressure correlated with the speed of the associated engine, an advance piston connected to said cam for adjusting its relative angular position to control the timing of the pumping strokes, a first hydraulic chamber at one end of said advance piston connected to said first source of fluid to move the advance piston to advance the timing in response to increased engine speed, a biasing spring biasing said advance piston in a direction in opposition to said first source of fluid, a second movable piston at the other end of the advance piston, a second source of fluid under a pressure correlated with engine operating condition other than speed, a second hydraulic chamber at the end of said second piston connected to said source of fluid, and a stop for limiting the movement of said second piston in the direction to retard timing, said second piston engaging the end of the advance piston opposite said first hydraulic chamber when a predetermined amount of advance in timing is reached.

2. A fuel injection pump comprising a cam, pump plungers movable relative to the cam to translate the contour of the cam to sequential pumping strokes, a first source of fluid under a pressure correlated with the speed of the associated engine, an advance piston connected to said cam for adjusting its relative angular position to control the timing of the pumping strokes, a first hydraulic chamber at one end of said advance piston connected to said first source of fluid to move the advance piston to advance the timing in response to increased engine speed, a biasing spring biasing said advance piston in a direction in opposition to said first source of fluid, a second movable piston at the other end of the advance piston, a second source of fluid under a pressure correlated with engine operating condition other than speed, a second hydraulic chamber at the end of said second piston connected to said source of fluid, said second piston being operatively connected to said advance piston to move said advance piston in the direction to retard timing, and a stop for limiting the movement of said second piston in the direction to retard the timing.

3. The fuel injection pump of claim 2 wherein said stop also serves to limit the maximum advance of the timing of the pumping stroke.

4. The fuel injection pump of claim 3 wherein the pump includes a metering valve for controlling the quantity of fuel delivered by the pump and metered fuel is the second source of fluid.

5. The fuel injection pump of claim 2 wherein a trimmer spring is provided to modify the operation of the load sensing piston.

6. The fuel injection pump of claim 2 wherein a compression spring operatively connects said second piston and said advance piston to apply a biasing force correlated with said second engine operating condition under all operating conditions.

7. The fuel injection pump of claim 1 wherein said advance piston and said second piston have approximately the same cross sectional area.

8. The fuel injection pump of claim 1 wherein the pump includes a metering valve for controlling the quantity of fuel delivered by the pump and metered fuel of the second source of fluid.

* * * * *